US008054238B2

(12) United States Patent
Lin

(10) Patent No.: US 8,054,238 B2
(45) Date of Patent: Nov. 8, 2011

(54) BALANCED PIFA AND METHOD FOR MANUFACTURING THE SAME

(75) Inventor: Junn Yi Lin, Hsinchu County (TW)

(73) Assignee: Ralink Technology Corporation, Hsinchu County (TW)

( * ) Notice: Subject to any disclaimer, the term of this patent is extended or adjusted under 35 U.S.C. 154(b) by 411 days.

(21) Appl. No.: 12/470,906

(22) Filed: May 22, 2009

(65) Prior Publication Data

US 2010/0085270 A1 Apr. 8, 2010

(30) Foreign Application Priority Data

Oct. 2, 2008 (TW) ..... 97137847 A

(51) Int. Cl.
*H01Q 1/50* (2006.01)

(52) U.S. Cl. ..... 343/859

(58) Field of Classification Search ..... 343/859, 343/821, 850, 860, 749, 853; 333/25–26; 455/333, 338

See application file for complete search history.

(56) References Cited

U.S. PATENT DOCUMENTS

| | | | | |
|---|---|---|---|---|
| 6,459,412 | B1 * | 10/2002 | Koyanagi et al. | 343/702 |
| 6,549,169 | B1 * | 4/2003 | Matsuyoshi et al. | 343/702 |
| 2009/0058751 | A1 * | 3/2009 | Suh et al. | 343/795 |
| 2009/0109104 | A1 * | 4/2009 | Ide et al. | 343/730 |
| 2009/0153415 | A1 * | 6/2009 | Hsieh et al. | 343/702 |
| 2010/0328185 | A1 * | 12/2010 | Soler Castany et al. | 343/860 |

* cited by examiner

*Primary Examiner* — Huedung Mancuso
(74) *Attorney, Agent, or Firm* — WPAT, P.C.; Anthony King

(57) ABSTRACT

A balanced patched inverse F antenna comprises a radiation conductor and a balun circuit. The radiation conductor includes a main body, a first branch and a second branch. The balun circuit includes an unbalanced port, a balanced port, and first, second, third and fourth components, with the first, second, third and fourth components being serially connected. A feeding input of the unbalanced port is connected to the second and third components, a grounding wire of the unbalanced port is connected to the first and fourth components, an inverting terminal of the balanced port is connected to the first and second components, a non-inverting terminal of the balanced port is connected to the third and fourth components, and the inverting and non-inverting terminals are respectively connected to the first and second branches.

18 Claims, 6 Drawing Sheets

BALANCED PIFA AND METHOD FOR MANUFACTURING THE SAME

BACKGROUND OF THE INVENTION

1. Field of the Invention

The present invention relates to an antenna design, and more particularly, to an antenna design providing stable grounding potential on a small-scaled substrate.

2. Description of the Related Art

With the widespread development of the wireless network transmission technologies, antenna performance, size, weight and versatility have become the most important factors affecting the price of the product. For a printed circuit structure of the prior art, grounding is deemed as one part of the antenna design. With a reduced substrate area, the grounding area is downsized accordingly, and the result causes the grounding potential of the grounding area to shift more easily due to totality of the operating environment. Because a good grounding potential is necessary for good transmission quality, there is a trend in today's market to design antennas with consideration toward both the size and the stable grounding potential.

SUMMARY OF THE INVENTION

A balanced patched inverse F antenna (PIFA) in accordance with one embodiment of the present invention comprises a radiation conductor and a balun circuit. The radiation conductor includes a main body, a first branch and a second branch. The balun circuit includes an unbalanced port, a balanced port, and first, second, third and fourth components, the first, second, third and fourth components being serially connected. A feeding input of the unbalanced port is connected to the second and third components, a grounding wire of the unbalanced port is connected to the first and fourth components, an inverting terminal of the balanced port is connected to the first and second components, a non-inverting terminal of the balanced port is connected to the third and fourth components, and the inverting and non-inverting terminals are respectively connected to the first and second branches.

An antenna apparatus in accordance with one embodiment of the present invention comprises an antenna body, a radio frequency (RF) signal processing module and a universal serial bus (USB) interface. The RF signal processing module is coupled to the antenna body for processing RF signals transmitted and received by the antenna body. The USB interface is configured to transmit signals from the RF signal processing module.

A method for manufacturing a balanced PIFA in accordance with one embodiment of the present invention comprises the steps of: forming a radiation conductor on a substrate by printing, wherein the radiation conductor has a main body, a first branch and a second branch; and disposing a transformation circuit on the substrate, wherein the transformation circuit is connected to the radiation conductor.

BRIEF DESCRIPTION OF THE DRAWINGS

The invention will be described according to the appended drawings in which.

PREFERRED EMBODIMENT OF THE PRESENT INVENTION

Figure 1:
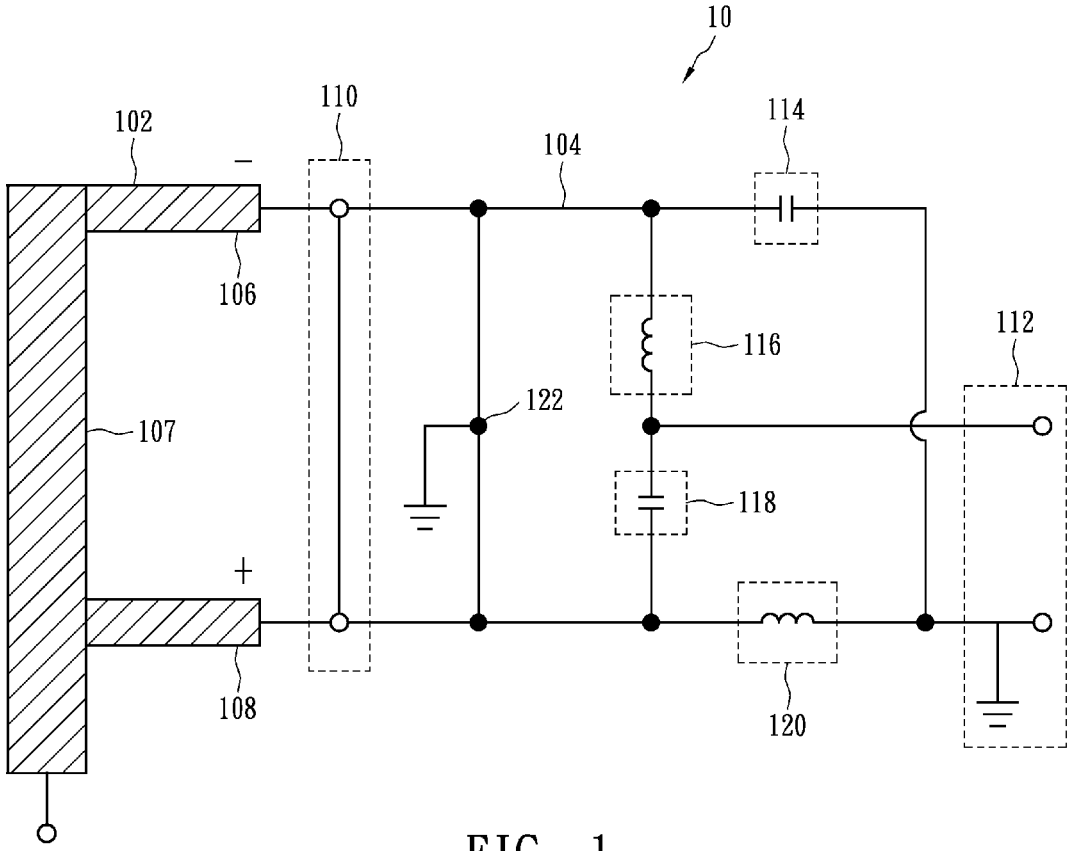
FIG. 1 shows a diagram of balanced PIFA according to one embodiment of the present invention.

FIG. 1 shows a diagram of balanced PIFA 10 according to one embodiment of the present invention. The PIFA 10 includes a radiation conductor 102 and a transformation circuit, such as a Balance-to-Unbalance circuit (Balun) 104. The radiation conductor 102 can be made of a conductive material, and has a main body 107, a first branch 106 and a second branch 108. The transformation circuit 104 has an unbalanced port 112, a balanced port 110, and a first component 114, a second component 116, a third component 118 and a fourth component 120 serially connected in a ring shape. The junction between the second component 116 and the third component 118 is coupled to a feeding input of the unbalanced port. The junction between the first component 114 and the fourth component 120 is coupled to a grounding wire of the unbalanced port 112. The junction between the first component 114 and the second component 116 is coupled to the inverting terminal of the balanced port. The junction between the third component 118 and the fourth component 120 is coupled to the non-inverting terminal of the balanced port 110. The inverting and non-inverting ports are respectively connected to the first branch 106 and the second branch 108 of the radiation body 102.

The transformation circuit 104 provides a relatively stable virtual ground 122 so that the noises from the ground can be controlled and the transceiving quality of the antenna can be improved. In well-known designs, for providing a stable grounding potential, it is common to have a large grounding area. In contrast, the present embodiment does not need much grounding area so that the whole circuit design is more flexible. In addition, if the impedances of the first to fourth components are well designed to form a bandpass filter effect, the leakage problem caused by placing multiple antennas on the same circuit board will be reduced.

In another embodiment of the present invention, the first component 114 and the third component 118 are capacitors, whose capacitances fulfill equation (1), and the second component 116 and the fourth component 120 are inductors, whose inductances fulfill equation (2).

$$\omega \cdot C = \frac{1}{\sqrt{2 * Zout * Zi}} \tag{1}$$

$$\omega \cdot L = \sqrt{2 * Zout * Zin} \tag{2}$$

where ω represents an angular frequency, C represents capacitance, L represents inductance, $Z_{out}$ represents impedance of the radiation conductor, and $Z_{in}$ represents impedance of the feeding input.

Figure 2:
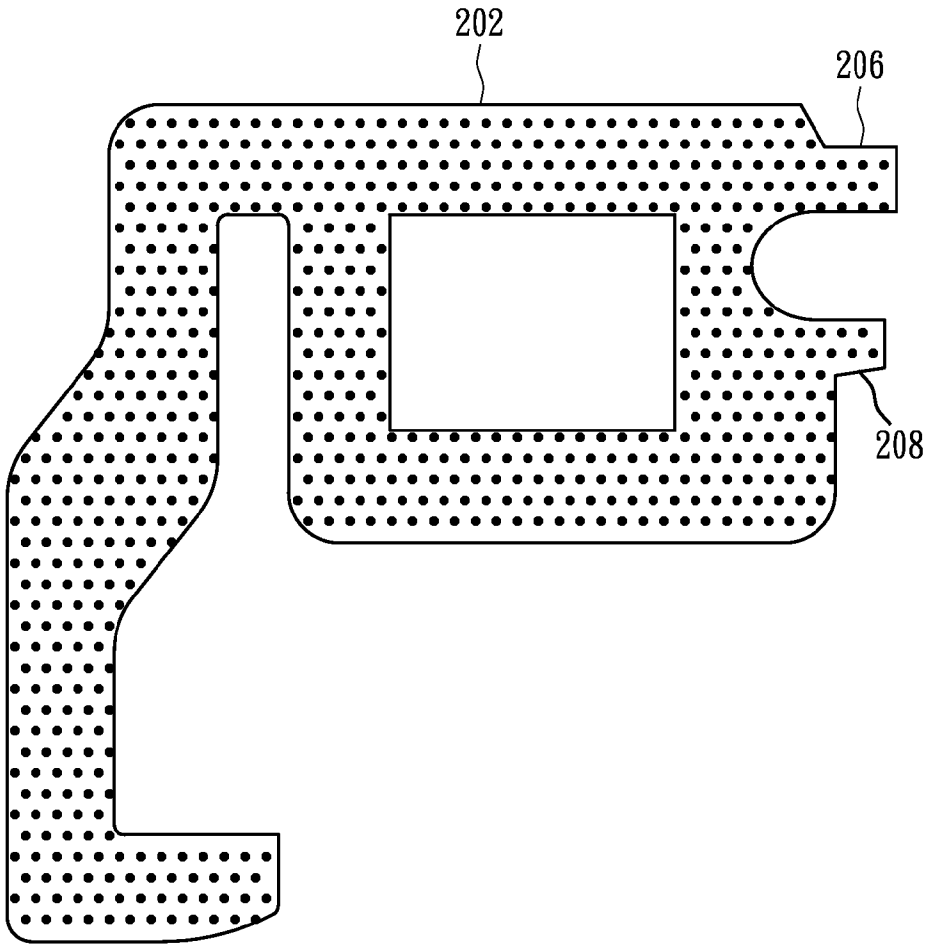
FIG. 2 shows a diagram of balanced PIFA according to one embodiment of the present invention.

In one embodiment of the present invention, the radiation conductor is an F-shaped structure, as shown in FIG. 1. In another embodiment, the radiation conductor 202 is shaped like the number "9," as shown in FIG. 2. The first branch 206 and the second branch 208 of the radiation conductor 202 are placed on two ends of the top of the 9-shaped structure.

Figure 3A:
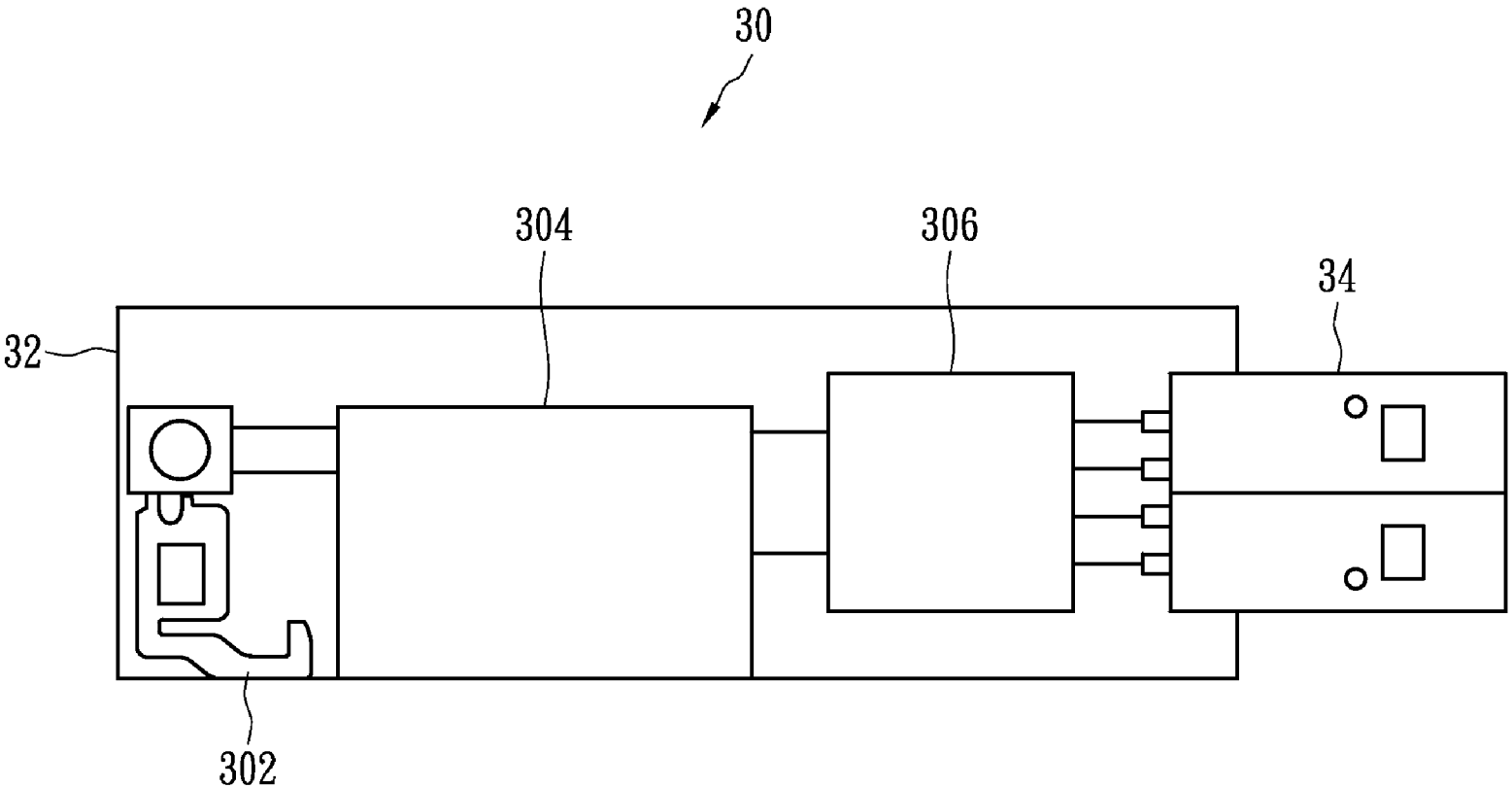
FIGS. 3A-3B show a structure of the antenna apparatus in accordance with the present invention.
Figure 3B:
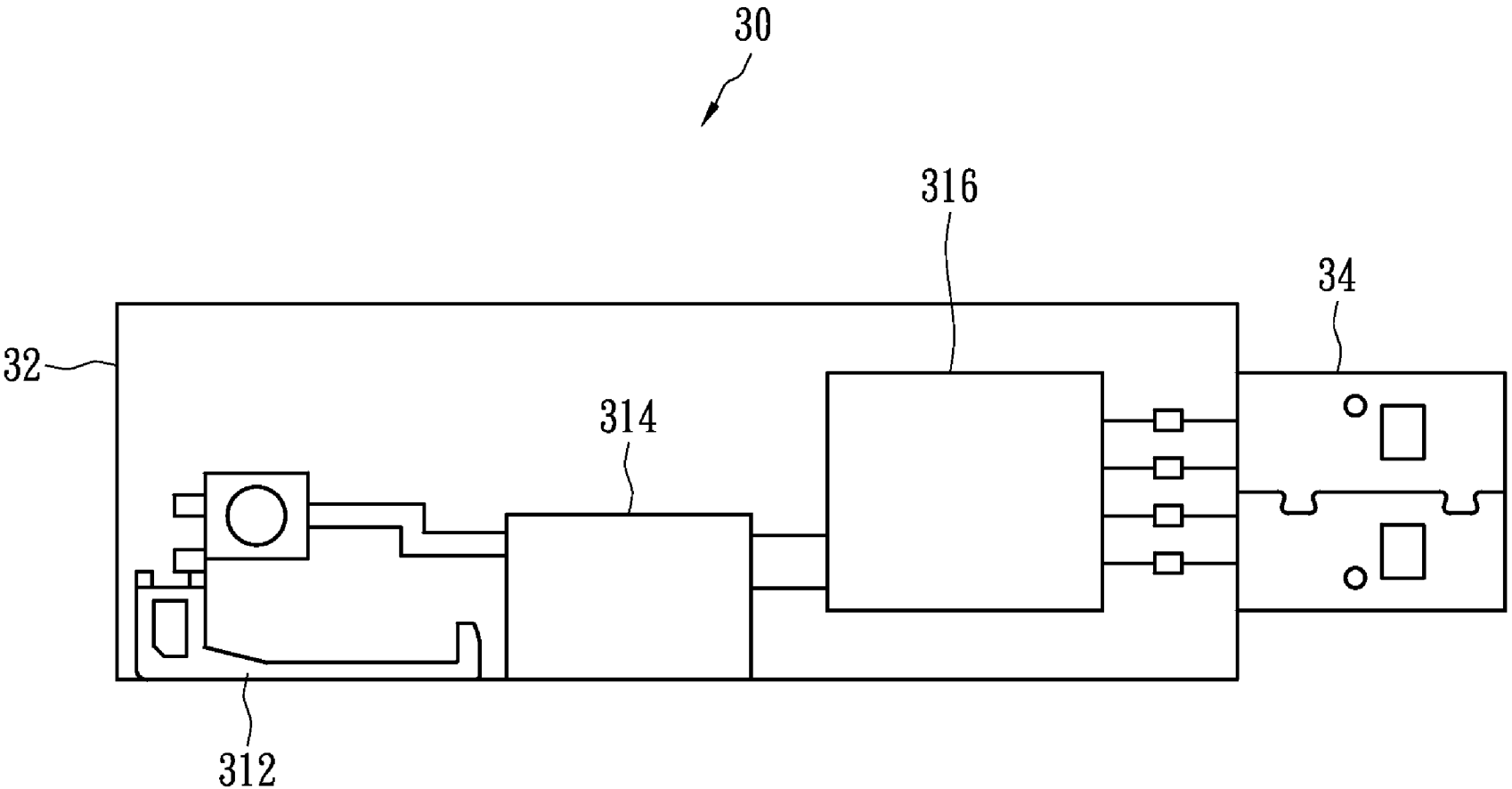

FIGS. 3A-3B show a structure of the antenna apparatus 30 in accordance with the present invention. The antenna apparatus 30 has a base 32, the first surface of which has a first antenna body 302, and a first radio frequency (RF) signal processing module 304. The second surface of the substrate 32 has a second antenna body 312 and a second RF signal processing module 314. The first and second RF signal processing modules 304, 314 are both coupled to a universal serial bus (USB) interface 34. The structures of the first antenna body 302 and the second antenna body 312 are similar to the balanced PIFA as shown in FIGS. 1 and 2. The RF frequency bands of the first antenna body 302 and the second antenna body 312 are different, and their quantities of frequency bands are most likely different, depending on different applications. The first and second RF signal processing modules 304, 314 are used to process transceiving signals of the first antenna body 302 and the second antenna body 312, which may include function modules of a low noise amplifier (LNA) or a power amplifier (PA).

In another embodiment of the present invention, the first surface of the substrate 32 further includes a first wireless network module 306, and the second surface further includes a second wireless network module 316. The first wireless network module 306 and the second wireless network module 316 separately process signals from the first RF signal processing module 304 and the second RF signal processing module 314, and then generate signals complying with wireless protocols. For example, the RF frequency band transceived by the first antenna body 302 is approximately 2.4 GHz-2.5 GHz, and the RF frequency band transceived by the second antenna body 312 is approximately 5.15 GHz-5.75 GHz. In addition, the first and second wireless network signal modules 306 and 316 employ network signals selected from the following standards: IEEE 802.11a, IEEE 802.11b, IEEE 802.11 and IEEE 802.11n.

One method for manufacturing the balanced PIFA in accordance with the present invention includes the step of forming a radiation conductor by a printing technique on a substrate, where the radiation conductor includes a main body part, a first branch and a second branch. Subsequently, a transformation circuit is placed on the substrate and connected to the radiation conductor, where the transformation circuit includes an unbalanced port, a balanced port and first to fourth ports serially connected in a ring shape. The junction between the second component and the third component is coupled to the feeding input of the unbalanced port. The junction between the first component and the fourth component is coupled to the grounding wire of the unbalanced port. The junction between the first component and the second component is coupled to the inverting terminal of the balanced port. The junction between the third component and the fourth component is coupled to the non-inverting terminal of the balanced port. The inverting and non-inverting ports are respectively connected to the first branch and the second branch of the radiation body.

In another embodiment of the present invention, the first to fourth components refer to the impedance design of the balanced PIFA as shown in FIG. 1. The radiation conductor can use a conductive material and be formed in an F-shaped pattern on the substrate by a printing technique. The first branch and the second branch of the radiation conductor are placed on two ends of the F-shaped structure. In another embodiment, the radiation conductor is formed in a 9-shaped pattern on the substrate by a printing technique.

Figure 4A:
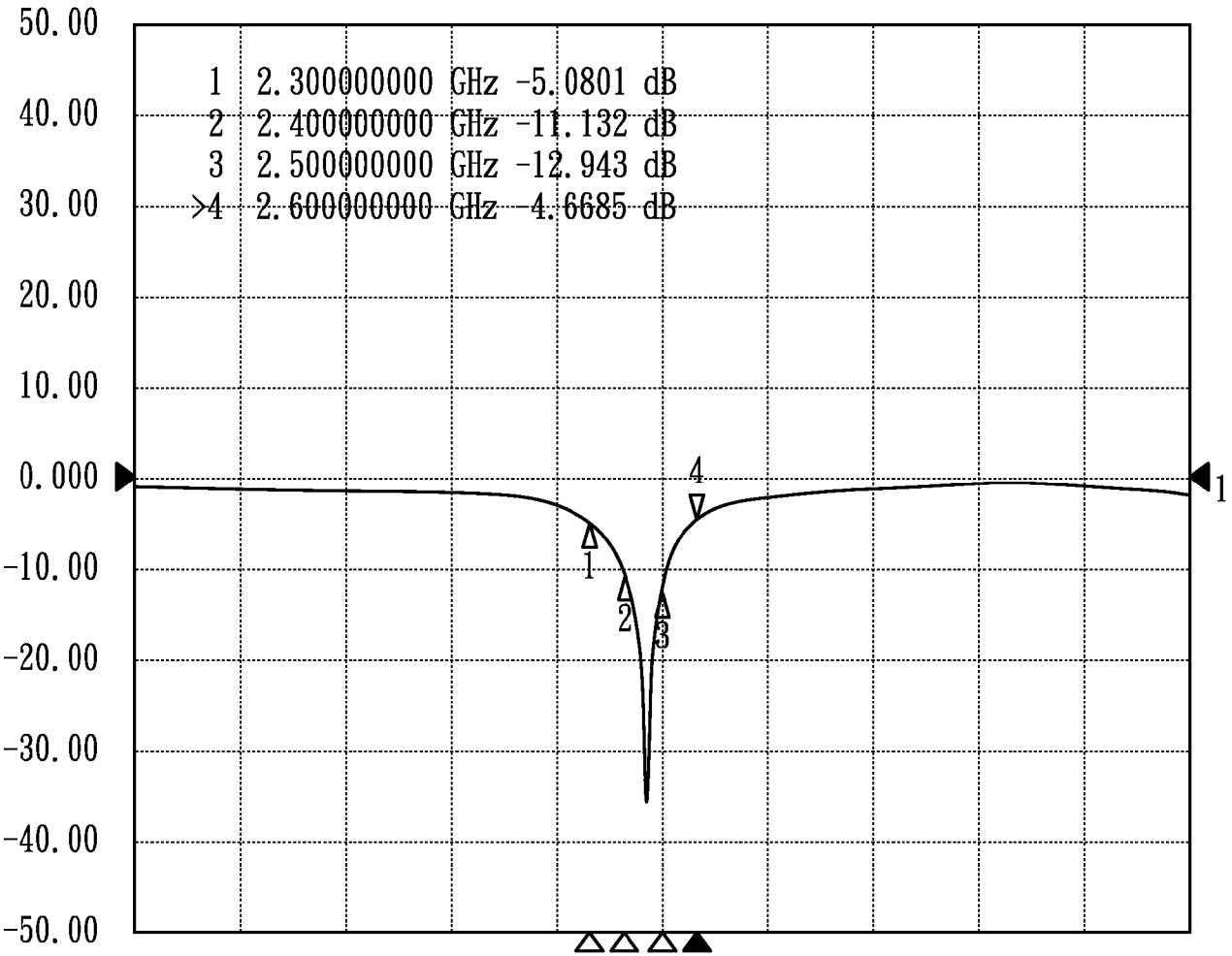
FIGS. 4A and 4B show experimental results of different frequency responses in accordance with different balanced PIFA.
Figure 4B:
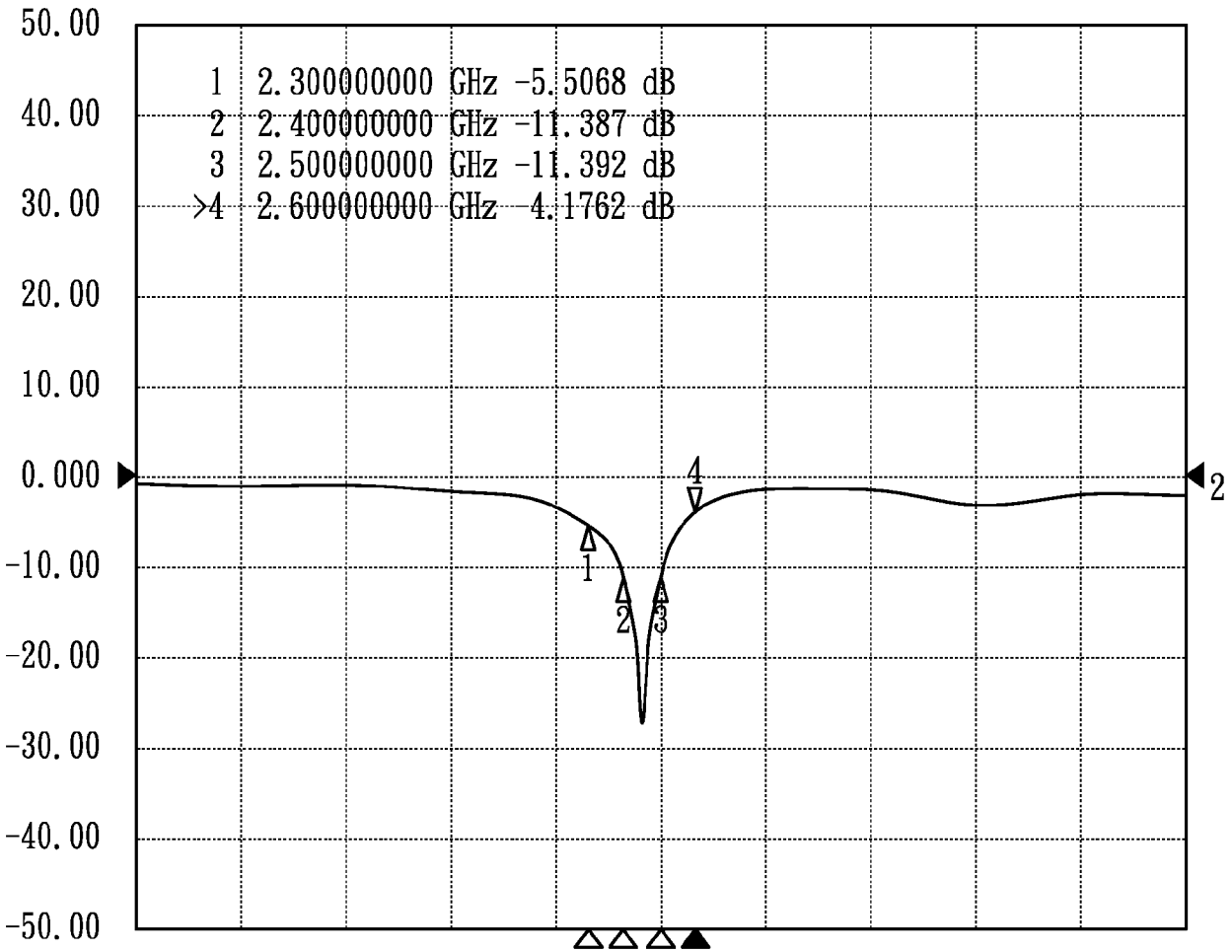

FIGS. 4A and 4B show experimental results of different frequency responses in accordance with different balanced PIFA. FIG. 4A shows a return loss of −11.132 dB at 2.4 GHz and −12.943 dB at 2.5 GHz. FIG. 4B shows a return loss of −13.182 dB at 2.4 GHz and −11.392 dB at 2.5 GHz. Both of these figures fulfill the condition that the return loss must be less than −10 dB.

The above-described embodiments of the present invention are intended to be illustrative only. Numerous alternative embodiments may be devised by persons skilled in the art without departing from the scope of the following claims.

What is claimed is:

1. A balanced patched inverse F antenna (PIFA), comprising:

a radiation conductor including a main body, a first branch and a second branch; and a balun circuit including an unbalanced port, a balanced port, and first, second, third and fourth components, the first, second, third and fourth components being serially connected, wherein a feeding input of the unbalanced port is connected to the second and third components, a grounding wire of the unbalanced port is connected to the first and fourth components, an inverting terminal of the balanced port is connected to the first and second components, a non-inverting terminal of the balanced port is connected to the third and fourth components, and the inverting and non-inverting terminals are respectively connected to the first and second branches.

2. The balanced PIFA of claim 1, wherein the first and third components are capacitors, and the second and fourth components are inductors.

3. The balanced PIFA of claim 2, wherein the first and third components fulfill a formula of $$\omega \cdot C = \frac{1}{\sqrt{2 * Zout * Zi}},$$

and the second and fourth components fulfill a formula of $\omega \cdot L = \sqrt{2 * Zout * Zin}$, where ω represents an angular frequency, C represents a capacitance, L represents an inductance, Zout represents impedance of the radiation conductor, and Zin represents impedance of the feeding input.

4. The balanced PIFA of claim 1, wherein the radiation conductor is an F-shaped structure, and the first and second branches are protruding portions of the F-shaped structure.

5. The balanced PIFA of claim 1, wherein the radiation conductor is substantially a 9-shaped structure.

6. The balanced PIFA of claim 1, wherein the radiation conductor is made of a conductive material.

7. An antenna apparatus, comprising:

an antenna body, comprising:

a radiation conductor including a main body, a first branch and a second branch; and a balun circuit including an unbalanced port, a balanced port, and first, second, third and fourth components, the first, second, third and fourth components being serially connected, wherein a feeding input of the unbalanced port is connected to the second and third components, the grounding wire of the unbalanced port is connected to the first and fourth components, an inverting terminal of the balanced port is connected to the first and second components, a non-inverting terminal of the balanced port is connected to the third and fourth components, and the inverting and non-inverting terminals are respectively connected to the first and second branches;

a radio frequency (RF) signal processing module coupled to the antenna body for processing RF signals transmitted and received by the antenna body; and a universal serial bus (USB) interface configured to transmit signals from the RF signal processing module.

8. The antenna apparatus of claim 7, wherein the antenna body and the RF signal processing module are a first antenna body and a first RF signal processing module, respectively, and located on a first surface of a substrate, and a second surface of the substrate opposite the first surface comprises:

a second antenna body comprising a radiation body and a balun circuit, the second antenna body configured to receive RF-band signals having a frequency band different from a frequency band of the first antenna body; and a second RF signal processing module coupled to the USB interface for transforming RF signals of the second antenna body into a second RF signal.

9. The antenna apparatus of claim 8, further comprising a first wireless network module, wherein the first wireless network module is coupled to the first RF signal processing module for transforming the RF signals into signals in compliance with wireless network protocols.

10. The antenna apparatus of claim 8, wherein the second surface further comprises a second wireless network module, and the second wireless network module is configured to transform the second RF signal into signals in compliance with wireless network protocols.

11. The antenna apparatus of claim 10, wherein the frequency band of the first antenna body is in a range of approximately 2.4 GHz to 2.5 GHz, the frequency band of the second antenna body is in a range of approximately 5.15 GHz to 5.875 GHz, and the first and second wireless network modules are configured to process signals in compliance with IEEE 802.11a, IEEE 802.11b, IEEE 802.11g or IEEE 802.11n.

12. The antenna apparatus of claim 7, wherein the first and third components are capacitors, and the second and fourth components are inductors.

13. The antenna apparatus of claim 12, wherein the first and third components fulfill a formula of $$\omega \cdot C = \frac{1}{\sqrt{2 * Zout * Zi}},$$

and the second and fourth components fulfill a formula of $\omega \cdot L = \sqrt{2*Zout*Zin}$, where ω represents an angular frequency, C represents a capacitance, L represents an inductor, Zout represents impedance of the radiation conductor, and Zin represents impedance of the feeding input.

14. A method for manufacturing a balanced PIFA, comprising the steps of:

forming a radiation conductor on a substrate by printing, wherein the radiation conductor has a main body, a first branch and a second branch; and disposing a transformation circuit on the substrate, wherein the transformation circuit is connected to the radiation conductor and comprises an unbalanced port, a balanced port, and first, second, third and fourth components; the first, second, third and fourth components are serially connected, wherein a feeding input of the unbalanced port is connected to the second and third components, the grounding wire of the unbalanced port is connected to the first and fourth components, an inverting terminal of the balanced port is connected to the first and second components, a non-inverting terminal of the balanced port is connected to the third and fourth components, and the inverting and non-inverting terminals are respectively connected to the first and second branches.

15. The method of claim 14, further comprising the steps of:

implementing the first and third components by capacitors; and implementing the second and fourth components by inductors.

16. The method of claim 15, wherein the first and third components fulfill a formula of $$\omega \cdot C = \frac{1}{\sqrt{2 * Zout * Zi}},$$

and the second and fourth components fulfill a formula of $\omega \cdot L = \sqrt{2*Zout*Zin}$, where ω represents an angular frequency, C represents a capacitance, L represents an inductor, Zout represents impedance of the radiation conductor, and Zin represents impedance of the feeding input.

17. The method of claim 14, wherein the forming step includes the step of forming an F-shaped conductive structure by printing on the substrate.

18. The method of claim 14, wherein the forming step includes the step of forming a 9-shaped conductive structure by printing on the substrate.

* * * * *